US007866788B2

(12) United States Patent
Jorba et al.

(10) Patent No.: US 7,866,788 B2
(45) Date of Patent: Jan. 11, 2011

(54) PRINTERS AND PRINTHEAD CLEANING PRIMARILY IN PAGE-WIDE ARRAY PRINTERS

(75) Inventors: Joan Jorba, Barcelona (ES); Sergio Puigardeu, Barcelona (ES); Jordi Sender, Barcelona (ES); Alex Andrea, Barcelona (ES); Silvia Miramanda, Barcelona (ES); Angel Martinez, Barcelona (ES); David Gaston, Barcelona (ES); Ramon Vega, Sabadell (ES); Marti Rius, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 195 days.

(21) Appl. No.: 12/244,792

(22) Filed: Oct. 3, 2008

(65) Prior Publication Data

US 2009/0128593 A1 May 21, 2009

Related U.S. Application Data

(60) Provisional application No. 60/988,608, filed on Nov. 16, 2007.

(51) Int. Cl.
*B41J 2/165* (2006.01)

(52) U.S. Cl. ..... 347/23; 347/29; 347/35

(58) Field of Classification Search ..... 347/23, 347/24, 29–33, 35, 42
See application file for complete search history.

(56) References Cited

U.S. PATENT DOCUMENTS 4,369,456 A * 1/1983 Cruz-Uribe et al. ..... 347/33
5,589,865 A 12/1996 Beeson

FOREIGN PATENT DOCUMENTS

| | | | |
|---|---|---|---|
| EP | 1454750 | | 9/2004 |
| JP | 2002-059559 | * | 2/2002 |
| JP | 2002356026 | | 12/2002 |
| JP | 2004082730 | | 3/2004 |

* cited by examiner

*Primary Examiner*—shih-wen hsieh
(74) *Attorney, Agent, or Firm*—Dicke, Billig & Czaja, PLLC

(57) ABSTRACT

A method of printing on a substrate and a printer are provided. The method uses a printer comprising a print head and a mask having a hole therethrough, the mask being disposed between the print head and the substrate, and comprises aligning the hole with the print head; printing on the substrate through the hole; and misaligning the hole with the print head so that the print head is covered by the mask. The method may allow the servicing of a print head in the array while the printer is printing on the substrate using at least one of the remainder of the print heads in the array.

20 Claims, 3 Drawing Sheets

PRINTERS AND PRINTHEAD CLEANING PRIMARILY IN PAGE-WIDE ARRAY PRINTERS

CROSS REFERENCE TO RELATED APPLICATIONS

This Application claims the benefit of provisional patent application Ser. No. 60/988,608, filed Nov. 16, 2007, titled "PRINTERS AND PRINTHEAD CLEANING PRIMARILY IN PAGE-WIDE ARRAY PRINTERS" which application is incorporated by reference herein as if reproduced in full below.

FIELD OF THE INVENTION

The present invention relates to a printer, and a method and apparatus for cleaning print heads, primarily but not exclusively, in a page-wide array printer, as well as to a printer incorporating such apparatus and a method of printing using such a printer.

BACKGROUND

In general, a page-wide array printer comprises a substrate transport path and a print head or array of print heads extending the full width of the substrate transport path. Such an arrangement allows the entire width of a substrate to be printed simultaneously.

It can be desirable to clean print heads from time to time. For example, debris may accumulate on the surface of a print head, and may adversely affect the operation of the print head.

Ink may dry on the surface of or within a print head, and may clog or block one or more nozzles of the print head. This is not usually a problem if a print head is printing continuously. However, if an image being printed has areas of white space (that is, ink-free areas), this may result in some or all of the nozzles of a print head not firing for several (for example, two, three, five or even more) seconds. In those periods when it is not operational, a nozzle may become blocked with dried ink.

In conventional scanning printers, in which the print head or heads move across a substrate perpendicular to the direction of travel of the substrate, these problems are alleviated by regularly moving the print heads to a cleaning station comprising a spittoon, for example at the end of each printing pass, or after each page has been printed. At the spittoon, the print heads may spit ink in order to keep the nozzles moist and prevent ink drying thereon.

EMBODIMENTS OF THE INVENTION

According to an embodiment of the invention, a method of printing and a page-wide array printer are provided as described in the appended claims.

BRIEF DESCRIPTION OF THE DRAWINGS

The invention will now be described, by way of example only, with reference to the accompanying drawings:

FIG. 1 shows schematically a page-wide array printer 1. The printer 1 comprises a print head array 3 on which one or more print heads 5 are mounted. The print head array may comprise a plurality of print heads, such as in of the order of five, fifty, one hundred, or even more. In some embodiments each print head of the array may be about 1 inch long. Ink is supplied to the print heads 5 in the array 3 from ink tank 7. The printer may comprise a print head array 3 for each colour or type of ink to be printed. However, for clarity, only one print head array is shown in the Figures.

Figure 1:
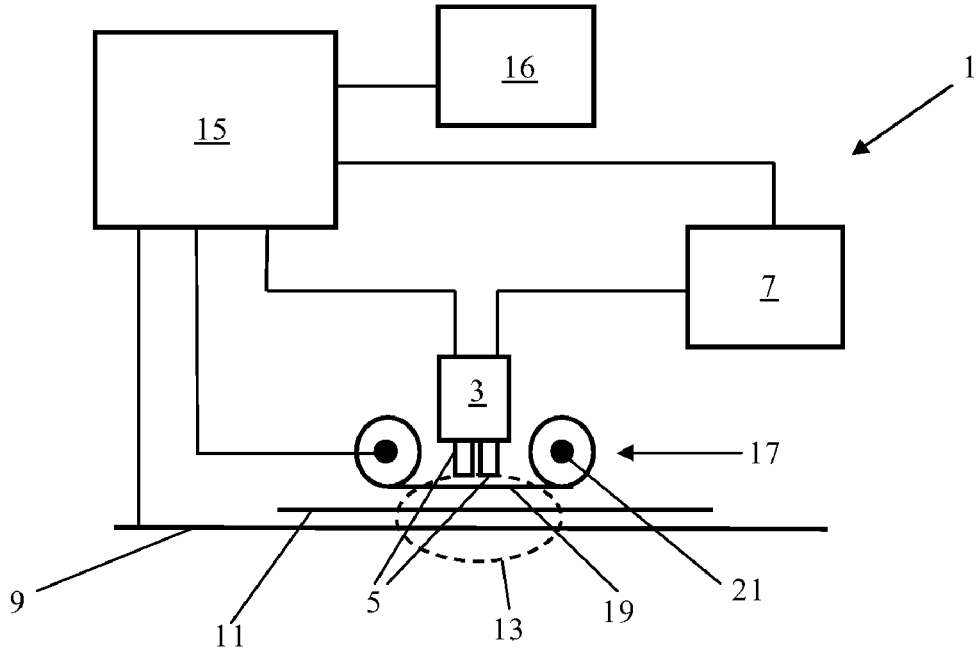
FIG. 1 is a schematic view of a page-wide array printer incorporating a cleaning device according to an embodiment of the invention.
Figure 1A:
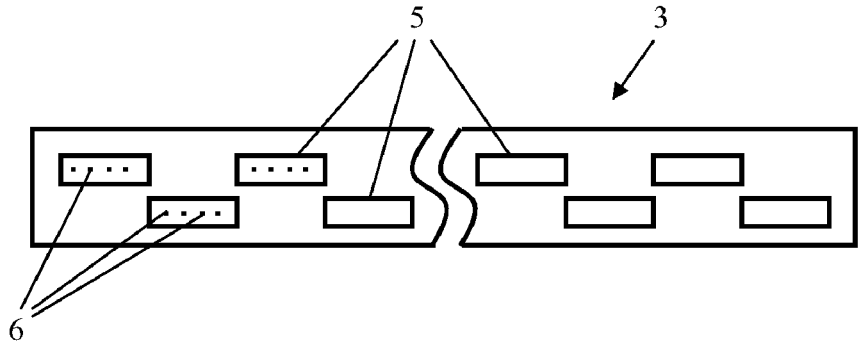
FIG. 1*a* is a print-side view of a print head array of the printer of FIG. 1.

A print head array is shown in more detail in FIG. 1*a*. The array comprises two rows of print heads, each of which comprises a number of nozzles 6. Although four nozzles are shown, in reality the number of nozzles is likely to be in the region of a hundred, five hundred, one thousand, or more. The structure of the print heads and nozzles in this particular embodiment is conventional, and will not be described in detail.

The printer 1 further comprises a substrate transport mechanism 9 which in use is operative to transport a substrate 11 to be printed upon through a print zone 13 below the print head array or arrays 3. Other embodiments may transport the substrate by pulling it from a roll using roller systems. In some embodiments the substrate transport mechanism may be a flat bed, or a belt or band. In other embodiments the head array 3 may move over a substrate support. Relative movement between the print head array 3 and the substrate to be printed upon in a direction transverse to the longitudinal extent of the head array 3 is what is required.

A printer controller 15, such as for example a microprocessor, is operative to control the firing of the nozzles 6 and the movement of the substrate through the print zone 13. The printer controller also controls the supply of ink to the print heads 5 from the ink tank 7. It will be appreciated that although one controller is shown, separate controllers could instead be provided for each of the substrate transport mechanism 9, the print heads 5 and the ink supply from a plurality of tanks 7.

The controller has access to a memory 16. Images or jobs for the printer to print are stored in memory 16 until they have been printed onto a substrate by the printer.

The printer 1 additionally comprises a print head servicing apparatus 17. The servicing apparatus comprises a mask or tape 19, shown in detail in FIG. 2. The tape is mounted on rollers 21, such that the mask 19 is located between the print heads and the substrate transport mechanism 9, within the print zone 13. The mask 19 comprises at least one hole 23 therethrough. The holes 23 are arranged in substantially the same configuration as the print heads, in this embodiment they are arranged in two staggered rows. The printer controller 15 is operable to wind the mask or tape from one roller 21 to the other, so as to move, or advance, the mask relative to the print heads, and to retreat the mask again (in some embodiments).

The holes 23 in the mask 19 can be aligned with the print heads 5, so that the print heads are able to print through the holes, or misaligned with the print heads 5, so that the print heads are able to print, or spit, on the mask 19.

The mask 19 is comprised of absorbent material, and may be in contact with the printing side of the print heads when the holes are misaligned with the print heads.

Figure 2:
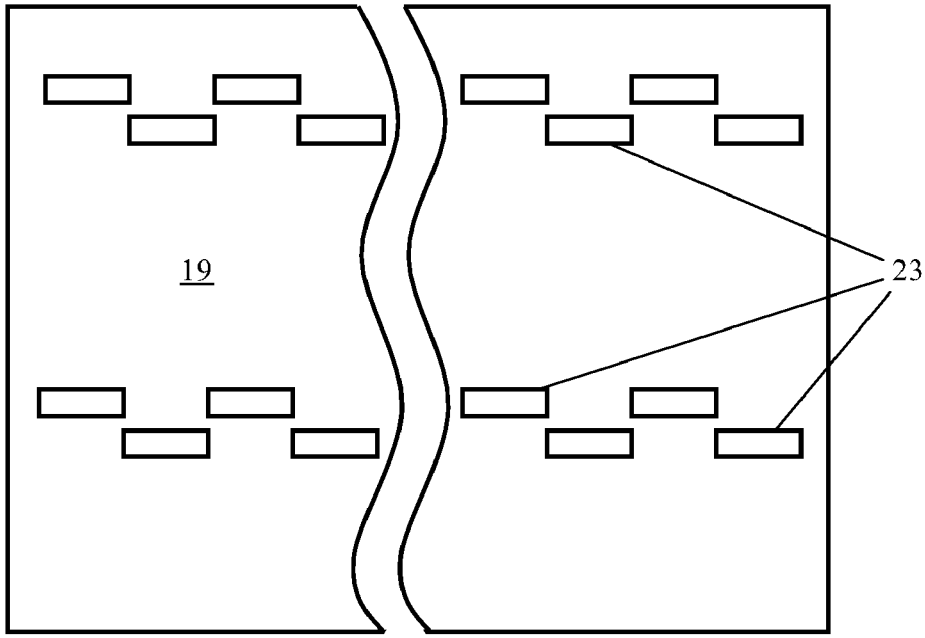
FIG. 2 is a partial view a cleaning tape for use with the embodiment of a printer shown in FIG. 1.

The mask shown in FIG. 2 is suitable for servicing or cleaning all the print heads in the array simultaneously, being substantially the same length as the array. Alternatively, a cleaning apparatus could be provided that is suitable for servicing less than all the print heads in an array. For example, the printer may comprise a plurality masks, each mask comprising at least one hole adapted to be aligned with one or more respective print heads in the array. The controller may be operable to cause the hole of a selected mask to be aligned with its respective print head(s) whilst the hole of a different selected mask is misaligned with its respective print head(s).

Figure 3:
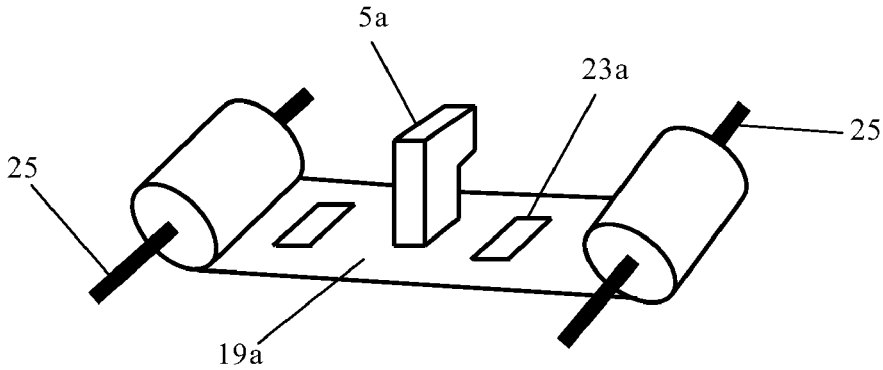
FIG. 3 shows an alternative embodiment of a cleaning device for a print head.

Each print head of the array could be provided with a respective mask. For example, FIG. 3 shows a cleaning apparatus that is substantially the same width as a single print head 5*a*. Thus the mask 19*a* can be advanced to align or misalign a hole 23*a* with the print head 5*a* through the mask without needing to align or misalign holes with other print heads in the array at the same time. That is, the alignment with a hole of each print head (or of a group of print heads) can be achieved independently of the alignment of each other print head (or other groups of print heads) in the array. Not all print heads in an array may need to be provided with a spitting/cleaning mask. For example, print heads near the edge of an array generally are more prone to drying, as images often do not extend right to the edge of a substrate. Such less used print heads are likely to need more regular servicing than print heads that are in continuous use, such as those near the centre of an array.

A cleaning device as shown in FIG. 3 could be mounted on a carriage, depicted schematically by rails 25, allowing the cleaning device to be moved along the array from one print head to another. More than one such mobile cleaning device could be provided.

Where the printer comprises more than one array, each array may be provided with its own cleaning mask or masks. Alternatively, a single mask may be provided to service all the arrays.

Figure 4:
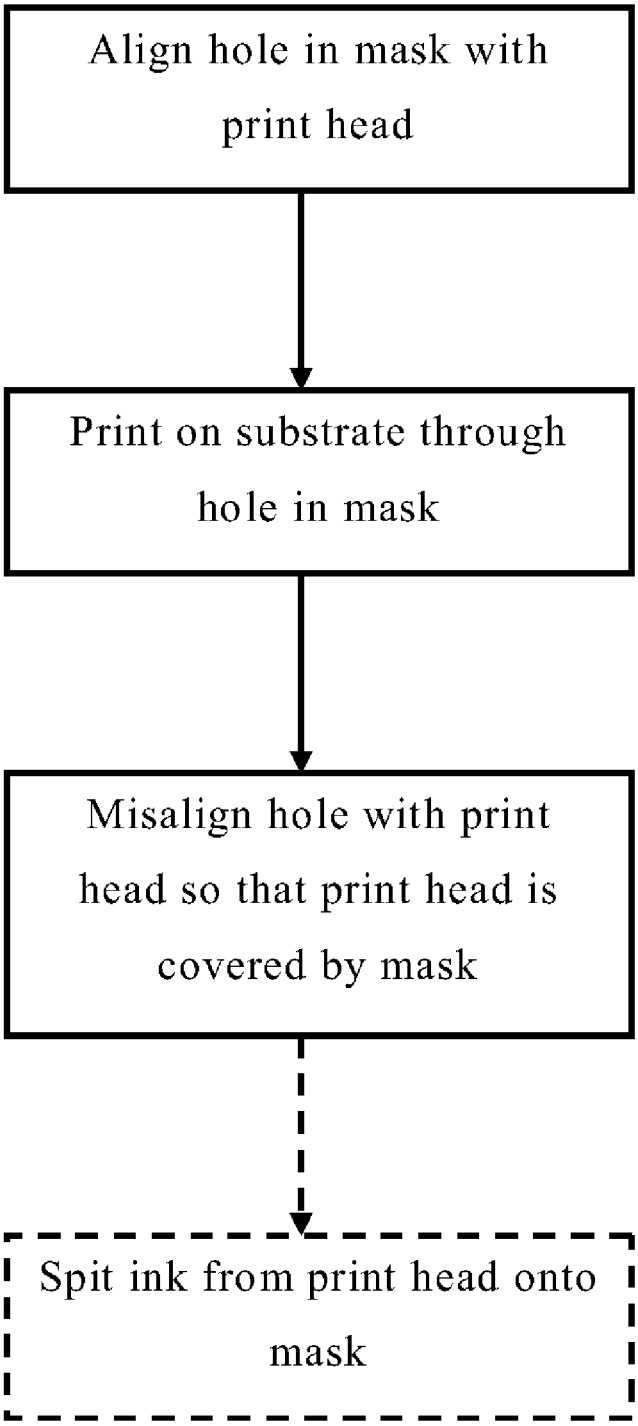
FIG. 4 is a flow chart setting out the steps of a method of printing according to an embodiment of the invention.

The operation of a printer in accordance with the invention will now be described, with reference to FIGS. 1 and 4. In the description below a 'print operation' refers to the operation of printing an image which is stored in the printer memory 16 onto a substrate.

In use, a substrate 11 (for example a sheet or web of paper, cardboard, plastics film, or the like) is carried through the print zone 13 of the printer 1 by substrate transport mechanism 9. The mask 19 is disposed between the print heads 5 and the substrate 11. Under the control of the printer controller 15 the mask is moved so as to align the holes 23 in the mask with the print heads 5. The controller then instructs the print heads to print on the substrate 11 through the holes 23 in the mask. The print heads continue to print as the substrate 11 is advanced through the print zone by the substrate transport mechanism, building up the image being printed on the substrate in a conventional way.

In this one embodiment, at the end of the print operation (ie when the printer has finished printing on the substrate), the controller misaligns the holes in the mask with the print heads so that the print heads are covered by the mask. The print heads are then instructed to spit ink onto the mask. The action of spiting ensures that even nozzles which have not been used at all during that print operation are kept moist and healthy.

Alternatively, it may be desirable to service one or more print heads in the array during the print operation. This may be achieved by stopping advancing the substrate, and stopping printing on the substrate (at least with the print heads in question), misaligning the holes in the mask with the print heads so that the print heads are covered by the mask, and spitting ink from those print heads onto the mask. The mask can then be moved (retreated or advanced) until the holes are aligned with the print heads, and printing can then continue. The print heads may be serviced during a print operation as often as required.

During printing, some print heads and/or nozzles may be used less frequently than others. In the embodiment of FIG. 3, a print head can be serviced while the printer is printing on the substrate using at least one of the remainder of the print heads in the array. For example, while a print head 5*a* in the array is not required to print the image at that moment in time, ie, whilst that print head is not in use, the hole 23*a* can be misaligned with that print head 5*a*. That print head 5*a* can then be serviced by spitting ink onto the mask. Whilst that print head, and perhaps other print heads, is being serviced, the printer continues printing on the substrate with at least one other print head in the array. Thus the print heads can be serviced during a print operation, without disrupting printing, improving printing efficiency as well as nozzle health. This can be useful, for example, if the substrate to be printed upon is not as wide as the print head array—i.e. there are unused print heads to the side of the substrate.

In an embodiment in which the mask is in contact with the printing surfaces of the print heads when the holes are misaligned with the print heads, the surfaces of the print heads are wiped with the mask as the mask is moved/advanced.

It will be appreciated that the embodiments of the invention described relate to page wide array pointers. However, in other embodiments there may not be an array of print heads—a page wide print head may be used. Furthermore, the print head/print head array need not (in some embodiments) necessarily extend completely across the "page" of the substrate to be provided upon. Whilst the invention finds good use in the field of page printers, it can be used in other printer configurations.

The discussion above mentions moving the mask to obstruct/cover the print head and then printing on the mask/spitting on the mask, and then moving the mask relative to the print head again to align a hole with the print head. The same hole can be aligned with a particular print head after spitting on the mask as was previously aligned with it, or a different hole aligned. The mask may move forwards or backwards to mask the print head and then forwards, or backwards, to re-align the print head with a hole.

The controller may keep track of how many times a particular part of the mask has been spat upon and may after a certain time/number of spitting operations, move the mask so that a different part of the mask is then spat upon. This may be to avoid the mask becoming saturated with ink. In some embodiments a region of the mask is printed upon/spat upon only once, or twice, or a limited low number of times before a fresh region of mask is used.

It will be appreciated that the mask will often have, in some embodiments, spread apart repeated patterns of holes that line up with and register with the print heads, In some embodiments the print heads may be moved over the mask.

In many embodiments of page wide array printers, it will be appreciated that the dimensions of the print head array are often very large, making moving the array difficult. If the array were to be moved to the side of the substrate transport path, the dimensions of the printer would be very large. By printing on a mask it is possible to avoid the need to move the print heads a long way. This can avoid using the time it would take to move the head a long way, and can avoid difficulties in moving the head back to exactly where it was before it was moved off to spit in a side service region.

Using embodiments of the invention, it is possible to service print heads without moving a print-head array large distances. Furthermore, the print heads may be serviced while a substrate is on a substrate transport mechanism, in a print zone beneath the print head array.

The print heads may spit on the mask at the same time as they are wiped by the mask.

Page wide array printer configurations can, of course, have static print heads.

A further advantage of some embodiments of the invention is that by having a spitting station inside of the plan area that is printed upon, the physical footprint of the printer is not extended by its spitting service station. The space needed to service the print heads is kept low.

The mask can be considered, in some embodiments, to be a wiper roll, or a wiper sheet.

It is envisaged that servicing of print heads intra-printing swath could take place, which will improve image quality, possibly improving problems with line/edge roughness. Not moving print heads can reduce the complexity, and cost of printers, and may improve reliability.

The invention claimed is:

1. A method of printing on a substrate using a printer comprising a print head and a mask having a hole therethrough, the mask being disposed between the print head and the substrate, the method comprising:

aligning the hole with the print head;

printing on the substrate through the hole; and misaligning the hole with the print head so that the print head is covered by the mask, the method performed in a printer comprising an array of print heads, the method further comprising misaligning the hole with at least one print head in the array whilst printing on the substrate with at least one other print head in the array.

2. The method of printing of claim 1, wherein when the hole is misaligned with the print head, a surface of the print head is wiped with the mask.

3. The method of printing of claim 1, further comprising the step of spitting ink from the print head onto the mask.

4. The method of printing of claim 1 performed on a page wide array printer.

5. A method of printing on a substrate using a page-wide-array inkjet printer having an array of print heads, the method comprising servicing a print head in the array while the printer is printing on the substrate using at least one of the remainder of the print heads in the array.

6. The method of printing of claim 5 wherein servicing a print head in the array comprises positioning a mask between the print head and the substrate, and misaligning a hole formed through the mask with the print head so that the print head is covered by the mask.

7. The method of printing of claim 6 wherein servicing a print head in the array further comprises at least one of wiping a surface of the print head with the mask and spitting ink from the print head onto the mask.

8. The method of printing of claim 5 wherein printing on the substrate using at least one of the remainder of the print heads in the array comprises positioning a mask between the at least one of the remainder of the print heads and the substrate, aligning a hole formed through the mask with the at least one of the remainder of the print heads, and printing on the substrate through the hole.

9. An inkjet printer comprising:

a print head;

a mask comprising a hole therethrough; and a controller operable to align the hole with the print head to allow the print head to print through the hole onto a substrate disposed beyond the mask, wherein the print head is part of an array of print heads, and further comprising a plurality of masks, each mask comprising at least one hole adapted to be aligned with one or more respective print heads in the array, the controller being operable to cause the hole of a selected mask to be aligned with a respective print head whilst the hole of a different selected mask is misaligned with a respective print head.

10. The printer of claim 9 wherein the printer is a page-wide-array inkjet printer and wherein the controller is further operable to misalign the hole with the print head so as to cover the print head with the mask.

11. The printer of claim 10 wherein the controller is operable to cause the print head to spit ink onto the mask when the mask is misaligned with the print head.

12. The printer of claim 9 wherein the printer is a page wide array printer.

13. The printer of claim 9 wherein the mask comprises a plurality of holes, each hole adapted to be aligned with a respective print head of the array.

14. The printer of claim 9 wherein the printer is a page-wide-array inkjet printer and comprising a carriage operable to move the mask to a desired location along the array.

15. The printer of claim 9 wherein the printer is a page-wide-array inkjet printer and wherein each print head of the array has a respective mask.

16. The printer of claim 9 wherein the mask comprises an absorbent material.

17. The printer of claim 9 wherein the printer is a page-wide-array inkjet printer and wherein the mask is held on a roller, wherein the controller is operable to cause the roller to turn, thereby moving the mask from a position in which the hole is misaligned with the print head to a position in which the hole is aligned with the print head, or vice versa.

18. An inkjet printer comprising:

a print head;

a mask comprising a hole therethrough; and a controller operable to align the hole with the print head to allow the print head to print through the hole onto a substrate disposed beyond the mask, wherein the print head is part of an array of print heads, and the controller is operable to misalign the hole of the mask with one print head of the array to service the one print head of the array while allowing another print head of the array to print onto the substrate.

19. The printer of claim 18 wherein the controller is operable to move the mask along the array from one print head of the array to another print head of the array.

20. The printer of claim 18 wherein the mask is held by rollers mounted on rails, and the controller is operable to rotate the rollers and to move the mask from one print head of the array to another print head of the array on the rails.

* * * * *